US006955591B2

(12) United States Patent
Deware

(10) Patent No.: US 6,955,591 B2
(45) Date of Patent: Oct. 18, 2005

(54) ADJUSTABLE ABRADING TOOL

(76) Inventor: William R. Deware, 4 South Rd., Belmont, NH (US) 03220

( * ) Notice: Subject to any disclaimer, the term of this patent is extended or adjusted under 35 U.S.C. 154(b) by 0 days.

(21) Appl. No.: 10/385,789

(22) Filed: Mar. 11, 2003

(65) Prior Publication Data

US 2004/0058633 A1 Mar. 25, 2004

Related U.S. Application Data

(63) Continuation-in-part of application No. 10/252,077, filed on Sep. 20, 2002, now abandoned.

(51) Int. Cl.[7] ..... B24D 9/02
(52) U.S. Cl. ..... 451/470; 451/495; 451/507
(58) Field of Search ..... 451/470, 463, 451/466, 495, 497–507, 471

(56) References Cited

U.S. PATENT DOCUMENTS 1,906,190 A * 4/1933 Tautz ..... 451/507
2,469,586 A * 5/1949 Wallace ..... 451/507
3,828,489 A * 8/1974 Culley, Jr. ..... 451/507
4,188,755 A * 2/1980 Fitzpatrick ..... 451/547
5,085,014 A * 2/1992 Sandhof ..... 451/463
5,185,970 A * 2/1993 Fiocchi ..... 451/507
6,685,547 B2 * 2/2004 Boman ..... 451/507

* cited by examiner

*Primary Examiner*—Hadi Shakeri
(74) *Attorney, Agent, or Firm*—Michael J. Persson; Lawson & Person, PC

(57) ABSTRACT

An abrading tool, abrasive star and abrading kit, in which the abrading kit includes the abrasive star and the abrading tool. The abrading tool includes a threaded drive rod, retaining member for retaining an abrasive material about the threaded drive rod, an expandable support disposed about the threaded drive rod and dimensioned to brace the abrasive material, an expanding member for expanding the expandable support to adjust the diameter of the outer surface of the abrasive material, and an adjusting knob having marls disposed incrementally along its outer surface in positions corresponding to diameters of the expandable support.

6 Claims, 11 Drawing Sheets

ADJUSTABLE ABRADING TOOL

RELATED APPLICATIONS

This application is a continuation-in-part of U.S. patent application Ser. No. 10/252,077, filed on Sep. 20, 2002 now abandoned.

FIELD OF THE INVENTION

The present invention relates to the field of rotating tools and, in particular, to a tool and kit for abrading holes, bores, chamfers and the like.

BACKGROUND OF THE INVENTION

It is common practice in the machine tool industry to use abrading tools to finish the walls (e.g., removing about 0.001 to 0.005 inches of material) of a previously provided bole or similar interior surface of a workpiece. Abrading operations generally correct inaccuracies in straightness and roundness in bore holes, can provide a uniform hole surfaces, or can remove burrs or finish surfaces.

A number of abrading devices have been developed to abrade, finish, polish or grind workpiece holes. U.S. Pat. No. 6,152,814 issued Nov. 28, 2000 describes an expandable abrasive sleeve for use on an inflatable tool to abrade or condition a surface of a workpiece. The expandable abrasive sleeve comprises an elastomeric backing, for example, made of a rubber material, and a plurality of separate abrasive strips adhered to the elastomeric backing in an overlapping relationship such that the strips overlap when the sleeve is expanded. The expandable abrasive sleeve is disposed around an inflatable bladder and inserted with a bore to be abraded. The sleeve is then inflated, causing it to expand until it bears against the inner walls of the bore, and rotated to abrade the inner wall.

Although this inflatable sleeve successfully abrades the inner walls of the bore, this system has a number of serious drawbacks. First, the diameter of the bore to be abraded is both uncontrollable and non-uniform. Because of the sleeve is necessarily made of a relatively pliable elastomeric material, the sleeve it does not maintain a uniform diameter and tends both to flare out the exposed ends of the bore and under-abrade areas within the bore. Second, an inflated sleeve cannot be inserted into the bore and, therefore, the tool is not readily adapted for abrading chamfers or anything less than an entire bore. Finally, the sleeve and tool system are relatively expensive. The tool requires a source of compressed air proximate to the workpiece to be abraded, requiring a significant upfront investment. Further, the inflatable sleeve requires laborious fabrication due to the process of attaching the abrading material. Each piece of abrading material must be adhered onto the tool one at a time. This burdensome process guarantees a high price for a tool that must be discarded after use.

U.S. Pat. No. 5,672,096 issued Sep. 30, 1997 describes an inflatable tool for abrading or finishing a surface of a workpiece. The inflatable tool includes an inflatable bladder clamped at first and second ends of a core having an elastomeric outer core portion. The inflatable bladder is inflated by a pressurized medium and forms a pocket or chamber around the elastomeric outer core portion. An abrasive sleeve is disposed around and secured by the inflatable bladder when inflated.

While this invention allows a tool to be inflated to various sizes and to chamfer, its lack of uniformity creates a serious drawback. The diameter is uncontrollable. This lack of diameter variance only allows a craftsman to abrade holes at a preset diameter controlled by the manufacturer. Furthermore, this tool hardly stands alone; it requires an air mandrel to expand the sleeve in order to abrade. This could be a significant upfront investment.

U.S. Pat. No. 3,232,011 issued Feb. 1, 1966 describes a pneumatically actuated expanding tool for grinding, polishing, and lapping tubing inside diameters or cylindrical bores. The tool employs abrasive cloth or paper which may be inserted into a tube or the like, and expanded to provide a controlled radial force or pressure on the inner surface of the tube while the tool is linearly advanced and retracted and/or rotated or oscillated back and forth about its longitudinal axis. Means are also provided for blowing air through the tool to cool it and to exhaust particles of abrasive dust from a tube in which the tool is employed.

Although this tool expands to grind and polish a hole, any expansion is unmeasurable. This tool could not effectively be used in conjunction with a portable drill. This prevents a machinist from abrading surfaces of deep holes, or abrading delicate or thin materials. Aside from this, any expansion requires another instrument to pneumatically pressurize the tool.

U.S. Pat. No. 2,605,594 issued Aug. 5, 1952 describes a pneumatically inflatable abrasive cylinder disposed at an opposite end from a hand pump. Squeezing the pump forces air into the cylinder causing it to expand. Sandpaper is wrapped around the cylinder. To abrade, the machinist inserts the cylinder into a hole, inflates, and radially rotates the cylinder by hand.

Although this tool is certainly cost-effective, using sandpaper and no external tools, it potency is highly suspect. First, to be productively relevant, an abrading machine requires a means for fastening itself to drill or similar machine. Wrist power might be acceptable when dealing with wood, but time and work efficiency demands more power when dealing with metal. Second, as a cylinder this tool is incapable of chamfering. Third, any expansion is immeasurable.

U.S. Pat. No. 5,800,252 issued Sep. 1, 1998 describes an abrading device extending from a tool mandrel connected in a cantilevered arrangement to a machine for rotating machining operations. A rigid honing member is secured to the tool mandrel, and configured such that the effective diameter of the substantially rigid abrasive outer surface of the honing member can be uniformly and precisely varied in a radial direction relative to the longitudinal axis of the tool in response to pressure on the interior surface of the honing member. A fluid distribution system formed in the tool mandrel in a predetermined arrangement is in fluid communication with the source of pressurized fluid, and includes a pressure chamber that is configured to apply fluid pressure to the interior surface of the honing member. At least one passage extends through the honing member from the pressure chamber and has an opening on the exterior surface of the honing member for delivering fluid to dissipate heat energy and remove debris.

While this invention may effectively solve some problems associated with debris removal and precise pressurization, it still requires a tool mandrel to pressurize internal fluid in order to expand. Despite any increase in precision associated with this invention, there is no method on the tool itself to measure the bore diameter. This tool could not effectively be used in conjunction with a portable drill. This prevents a machinist from abrading surfaces of deep holes, or abrading delicate or thin materials. As this invention expands after entry into a previously bore hole, it is incapable of chamfering.

U.S. Pat. No. 6,083,086 issued Jul. 4, 2000 describes an expanding device for grinding sleeves. The device has a cylindrical member with an outer surface, an interior chamber, an expanding chamber, and a locking mechanism. The outer surface receives the grinding sleeve, the interior chamber receives a rotatable shaft, and the expanding chamber comprises an expanding material, illustratively water, rubber, polyethylene and other known expandable polymers water-based solutions and oil-based solutions, that expands and contracts based upon pressure applied by use of a locking mechanism. The grinding sleeve can be sandpaper, diamond, emery cloth or any conventional material that grinds metal, wood, or plastic materials.

Although this grinding device allows cost-effective and simple replacements due to the use of conventional sand paper, the ability to control the diameter to an easily measurable degree is still absent. The invention works by using numerous expanding surfaces and diameters, in conjunction with liquid solutions. Using liquids in this manner of pressurizing is an improvement over previous air-pressure and liquid-pressure tools. This tool requires no external apparatus for pressurization. While this tool expands without use of a hand tool or mandrel, all the elaborate intricacies involved in the expansion ensure a hefty tool price. Also, this tool could not effectively be used in conjunction with a portable drill. This prevents a machinist from abrading surfaces of deep holes, or abrading delicate or thin materials.

U.S. Pat. No. 6,203,410 issued Mar. 10, 2001 describes a reamer with adjustable expansion/contraction and a bore finishing section comprising the reamer. The grinding section is cylindrically shaped, and has a plurality of axially-extending slits in its peripheral wall and a tapered inner surface. The rotation shaft is connected via threaded sections to a sliding shaft, which is in turn connected to a diameter expansion member consisting of a tapered cone fitted into the tapered inner surface of the grinding section. When the rotation shaft is operated to rotate, the rotational motion is converted into linear motion of the slide shaft due to a guide pin and a guide hole. The linear motion moves the diameter expansion member back and forth inside the grinding section, thereby contracting/expanding the outer diameter of the grinding section mechanically and precisely.

Although this tool's diameter expands or contracts by rotating a member located on its top, instead of using a pressurized medium, this expanded/contracted diameter is not measurable by the tool. The abrading material mentioned, diamond grindstone, is electrically deposited onto the tool. This expensive material combined with the fact that it is permanently attached to the tool, makes the tool's reusability impractical. This tool could not effectively be used in conjunction with a portable drill. This prevents a machinist from abrading surfaces of deep holes, or abrading delicate or thin materials. Furthermore, this cylindrical tool is incapable of chamfering.

Although this grinding device allows cost-effective and simple replacements due to the use of conventional sand paper, the ability to control the diameter to an easily measurable degree is still absent. The invention works by using numerous expanding surfaces and diameters, in conjunction with liquid solutions. While this tool expands without use of a hand tool, the elaborate expansion devices ensure a hefty tool price. This tool could not effectively be used in conjunction with a portable drill. This prevents a machinist from abrading surfaces of deep holes, or abrading delicate or thin materials.

U.S. Pat. No. 5,390,448 issued Feb. 21, 1995 describes a modular expandable honing tool or mandrel, which is adjustable within limits during a honing operation. The modular tubular honing assembly includes a drive member for attaching to a typical honing machine, a cage member adaptable for slidably receiving the abrasive sleeve member, and a retainer member for holding the abrasive sleeve member in operative position within the cage member. The abrasive sleeve member has inner and outer surfaces, the inner surface being conically tapered over its entire length while its outer surface includes a plurality of circumferentially spaced longitudinal projections positioned adjacent longitudinal channels, each projection including a honing surface having abrasive particles located thereon. The abrasive sleeve member also includes an elongated slot extending along its entire length on one side thereof which enables such member to uniformly radially expand and contract when the expander member is axially moved therethrough, the expander member having at least a portion of its outer surface which extends through the abrasive sleeve member likewise tapered at the same conical taper rate as the taper associated with the inner surface of the abrasive sleeve member for making surface-to-surface contact with the tapered inner surface of the abrasive sleeve member. Axial movement of the expander member within the abrasive sleeve member changes the diameter of the sleeve member uniformly along its entire length during a honing operation.

While this invention allows for expansion of the tool's circumference, this expansion must occur during the abrading process. The honing surfaces require must be coated or plated with an abrasive material, instead of using a simple sleeve or sandpaper. There is no gauge to indicate precise measurement. As a primarily honing tool, this tool could not abrade delicate surfaces or non-uniform holes. Furthermore, due to its cylindrical shape, this tool is incapable of chamfering.

U.S. Pat. No. 5,155,944 issued Oct. 20, 1992 describes a device for honing a workpiece surface to be machined to provide a finished size and surface configuration comprising a honing tool with adjustable honing elements, the elements having a cutting zone and a calibrating zone, and also, comprising a guide element with a surface sized to the finished size of the workpiece surface such that on the cutting stroke of the tool the cutting zone performs the cut and the tool is guided by the movement of the calibrated zone through the guide element and the abraded surface.

While this tool can manually adjust its diameter, this adjustment exists to compensate for abrasive deterioration. Any adjustments, which are minute, are neither readily measurable nor designed to allow an operator to work with holes of differing sizes.

U.S. Pat. No. 5,088,237 issued Feb. 18, 1992 describes a honing tool for machining a workpiece bore in one working stroke with honing coatings set in fixed manner to the desired size of the bore, has on a non-adjustable part of the tool body and preferably in the vicinity of a guide zone, air measuring nozzles. During the tool return stroke, these nozzles are subject to an action through the bore and measure the final size of the latter following the working zone. Optionally a readjustment can be automatically initiated as a function of the result via an adjustable body. The adjusting body is adjustable in its axial position by an adjusting device. It comprises a threaded bolt, which is rotatable by means of a hexagonal rod and moves the adjusting body in conjunction with a thread in the tool body. The tool body is circumferentially provided with five slots, which extend radially outwards from its bore and in which are guided honing strip or ledge carriers, which are covered on their outside by abrasive coatings. The honing strip carriers beveled on their inside corresponding to the conical bevel are pressed against the same by two tubular springs.

While this tool allows accurate measurement, it measures the hole after the abrasion is finished. This measurement purely exists to check accuracy, not to allow a machinist with the same tool to finish another differently sized hole. This tool could not effectively be used in conjunction with a portable drill. This prevents a machinist from abrading surfaces of deep holes, or abrading delicate or thin materials. Furthermore, the abrasion is a part of the tool, requiring that the entire tool be discarded after significant abrasion-wear.

U.S. Pat. No. 3,861,091 issued Jan. 21, 1975 describes an internal honing tool that includes a tool body which has an outer periphery and a plurality of circumferentially spaced recesses therein. The recesses include first and second portions and extend through the outer periphery of the tool body. Abrasive members are mounted in the first portions of each of the recesses and extend outwardly beyond the outer periphery of the tool body for honing a work piece. Securing members removably secure guides and abrasive stones to the tool body. The structure avoids wear of the tool body while only the abrasive members and guide members require replacement.

Although this invention allows a machinist to replace the abrasives instead of the entire tool, the tool is overly complicated and replacing the abrasives is inconvenient. This tool could not effectively be used in conjunction with a portable drill. This prevents a machinist from abrading surfaces of deep holes, or abrading delicate or thin materials. This attribute is designed to only prevent wear and in no way accurately expands or contracts the grinding diameter.

U.S. Pat. No. 4,065,881 issued Jan. 3, 1978 describes a generally cylindrical honing tool for internally honing a workpiece which may have an interrupted bore. It has plurality of radially disposed axially extending tool supported thermoplastic guide members for engaging the workpiece at a first relatively constant pressure to aid in aligning the tool with the workpiece and having a plurality of radially disposed axially extending tool supported abrasive elements for engaging the workpiece at a pressure which is variable and independent of the guide pressure for abrading material from the workpiece.

Although this invention allows the grinding section of the tool to expand, any expansion is immeasurable. This machine is designed to extend its abrasives after insertion into a hole. This tool could not effectively be used in conjunction with a portable drill. This prevents a machinist from abrading surfaces of deep holes, or abrading delicate or thin materials. It uses embedded grinding blocks instead of inexpensive sandpaper.

U.S. Pat. No. 3,166,876 issued Jan. 26, 1965 describes a coated abrasive construction adapted to be formed into a variety of abrading or polishing implements. It is capable of conforming to various contours and adjusting to various diameter openings. An abrasive band is mounted upon an expandable rubber mandrel which is adapted to be rotated by a suitable power source. Fixing the free end of the device at the desired degree of expansion can control the degree of expansion. This can be done permanently with the use of appropriate mandrels of temporarily by use of tape, threaded mandrels with an adjusting nut or by such other means as desired.

Although this tool uses inexpensive, although specialized, sandpaper as an abrasive means, the method of expansion is entirely impractical. No consideration is given for means to expand or contract the rubber implement, instead the machinist forces the rubber to contort and locks it into place. Next, the shape of the machine necessitates that sandpaper be cut into small, joined strips. During honing these small strips are not in sufficient contact with a support surface to effectively abrade. Using centrifugal force to expand an abrasive against an interior surface of a hole will frequently be inadequate. Also, these individual strands of sandpaper are more delicate than many jobs will require. Finally, any expansion is immeasurable.

Specialized sandpaper known as cloth stars exist to lightly grind the interior of tubing. This type of sandpaper consists of two sheets of sandpaper, each with multiple rectangular protruding blades, fastened to each other so that the rear sheet's blades fill any voids caused by the front sheet's blade gaps. Generally, a threaded metal plate fastens these two sheets.

While this type of sandpaper fits into a tube, it is wholly inadequate to expand or chamfer a hole. This paper is also restricted in the types of materials and shapes that it may sand, as the exposed edges on the front sheet of the star tend to catch on most non-uniform surfaces causing the edges to bend against the direction of radial motion exposing the non-abrading rear surface of the sandpaper to a workpiece. In addition, the use of multiple sheets of sandpaper makes these stars relatively stiff and unsuited to freely conform to the inside surfaces of bores. Finally, as a metal fastener must mechanically join the two pieces of specially cut sandpaper, the cost of these stars tends to be relatively high.

Therefore, there is a need for a tool that expands without the use of pressurizing material (liquids, air, etc.) and the machines inevitably required to administer and measure such material, that uses an inexpensive, easily replaceable material such as sandpaper, that can set its diameter before engaging a hole and hold the size to be abraded, that can chamfer a hole, that creates uniform diameters, that is versatile enough to engage hole of differing diameters, that abrades non-uniform holes, that can be extended to abrade surfaces of deep holes, that abrades delicate or thin materials, that can abrade hardened steel, that can be attached to a drill or similar apparatus, that can abrade soft or elastic materials, such as rubber. Finally, there is a need for an abrasive star that can abrade non-uniform surfaces in the interior of a tubular surface without catching.

SUMMARY OF THE INVENTION

The present invention is an abrading tool, abrasive material and abrading kit that overcome the drawbacks inherent in the prior art. In its most basic form, the abrading tool of the present invention includes a threaded drive rod, a means for retaining an abrasive material about the threaded drive rod, an expandable support disposed about the threaded drive rod and dimensioned to brace the abrasive material, and a means for expanding the expandable support.

In the preferred embodiment, the means for retaining the abrasive material includes a lock cap having an opening disposed about the threaded rod and an inside surface dimensioned to mate with the outside surface of the abrasive material, and a compressible locking member disposed about the threaded rod proximate to the inside surface of the abrasive material. The lock cap may be threaded to mate with the drive rod, but the preferred lock cap is not threaded but rather is engaged by a lock knob having a threaded opening to mate with the threaded rod and an engagement surface dimensioned to engage a mating surface of the lock cap. The preferred compressible locking member is an O-ring, though compressible protrusions extending from the means for expanding would also work.

The preferred embodiment uses an elastic drum for an expandable support. Rubber is an excellent material from which to construct the expandable support.

The preferred embodiment uses inner and an outer spacer, situated at both ends of the elastic drum as a means for expanding the elastic drum. The inner spacer and outer spacer are both dimensioned to contact the elastic drum. Axial movement of the outer spacer toward the inner spacer causes the elastic drum to expand. It is preferred that the inner spacer be threaded, but it is understood that this need not be so. The preferred embodiment also includes an adjusting knob that is threaded to mate with, and situated about, the drive rod and in communication with the outer spacer rod to adjust the outer spacer. Radial rotation of the adjusting knob axially moves the outer spacer.

A second embodiment of the expandable support uses a substantially resilient cylinder having an open end, a closed end and a sidewall having a plurality of axial cuts. This sidewall may be forced outward to form a substantially conical surface. The preferred embodiment of this second type of expandable support is threaded to mate with the drive rod. The preferred means for expanding this second embodiment comprises an outer spacer dimensioned to engage the open end of the expandable support. Moving this outer spacer toward the closed end of the expandable support engages the resilient cylinder causing the diameter of the open end to increase. The preferred outer spacer for this second embodiment is substantially conically shaped so as to mate with this expandable support. As in the preferred embodiment this second embodiment uses an adjusting knob threaded to mate with the drive rod and in communication with the outer spacer. Radial rotation of the adjusting knob moves the outer spacer axially along the drive rod. Finally, the preferred embodiment of the tool also includes a means for setting a diameter of the expandable support and a means for quick-connection to a drill.

The abrasive star of the present invention is manufactured from a substantially flexible material having a plurality of abrasive particles disposed upon one surface thereof. The star includes a central hub from which a plurality of flaps extend. The flaps are defined by a plurality of gaps, and each flap includes a left side, a right side and an end. A slit is disposed through the left side of each flap proximate to the central hub and extends substantially tangentially to the hub toward the right side of each flap. The gaps and slit are dimensioned to allow the flaps to be folded upward such that right side of each flap to overlaps the left side of each adjacent flap, forming one of a substantially cylindrical outer surface and a substantially conical outer surface. In this manner, a single abrasive star may be fitted to the expandable support, providing a substantially flexible and unbroken abrasive surface that cannot be achieved using current abrasive stars.

The gaps of the preferred stars are substantially triangularly shaped and extend from the edge of the abrasive material to a first location on a circumference of a first circle located between the edge of the sheet and the opening. The right triangle gaps decrease in width from the end of each flap to the junction of each flap with the central hub.

The preferred abrading kit includes at least one abrading tool and at least one abrasive star in accordance with the present invention Therefore, it is an aspect of the invention to provide an abrading tool that expands without the use of pressurizing material (liquids, air, etc.) and the machines inevitably required to administer and measure such material, It is a further aspect of the invention to provide an abrading tool that uses an inexpensive, easily replaceable material such as sandpaper, It is a further aspect of the invention to provide an abrading tool that can measure its diameter before engaging a hole.

It is a further aspect of the invention to provide an abrading tool that can chamfer a hole and/or adjust the angle of a chamfer from 20° included to 90° included.

It is a further aspect of the invention to provide an abrading tool that creates uniform diameters.

It is a further aspect of the invention to provide an abrading tool that is versatile enough to engage hole of differing diameters.

It is a further aspect of the invention to provide an abrading tool that can be extended using commercially available adapters to abrade surfaces of deep holes.

It is a further aspect of the invention to provide an abrading tool that may be used to abrade non-uniform holes to true round holes.

It is a further aspect of the invention to provide an abrading tool that abrades delicate or thin materials.

It is a further aspect of the invention to provide an abrading tool that may be manufactured substantially entirely of non-corrodible materials.

It is a further aspect of the invention to provide an abrading tool that can abrade hardened steel.

It is a further aspect of the invention to provide an abrading tool that can abrade soft or elastic materials, such as rubber.

It is a further aspect of the invention to provide an abrading tool and that has a hex shaped shank for attachment to a drill or speed lock apparatus.

It is a further aspect of the invention to provide for an abrasive that can abrade non-uniform surfaces in the interior of a tubular surface, such as keyways or cutouts, without catching.

These aspects of the invention are not meant to be exclusive. Other features, aspects and advantages of the present invention will be readily apparent to those of ordinary skill in the art when read in conjunction with the following description, appended claims and accompanying drawings.

DETAILED DESCRIPTION OF THE INVENTION

Figure 1:
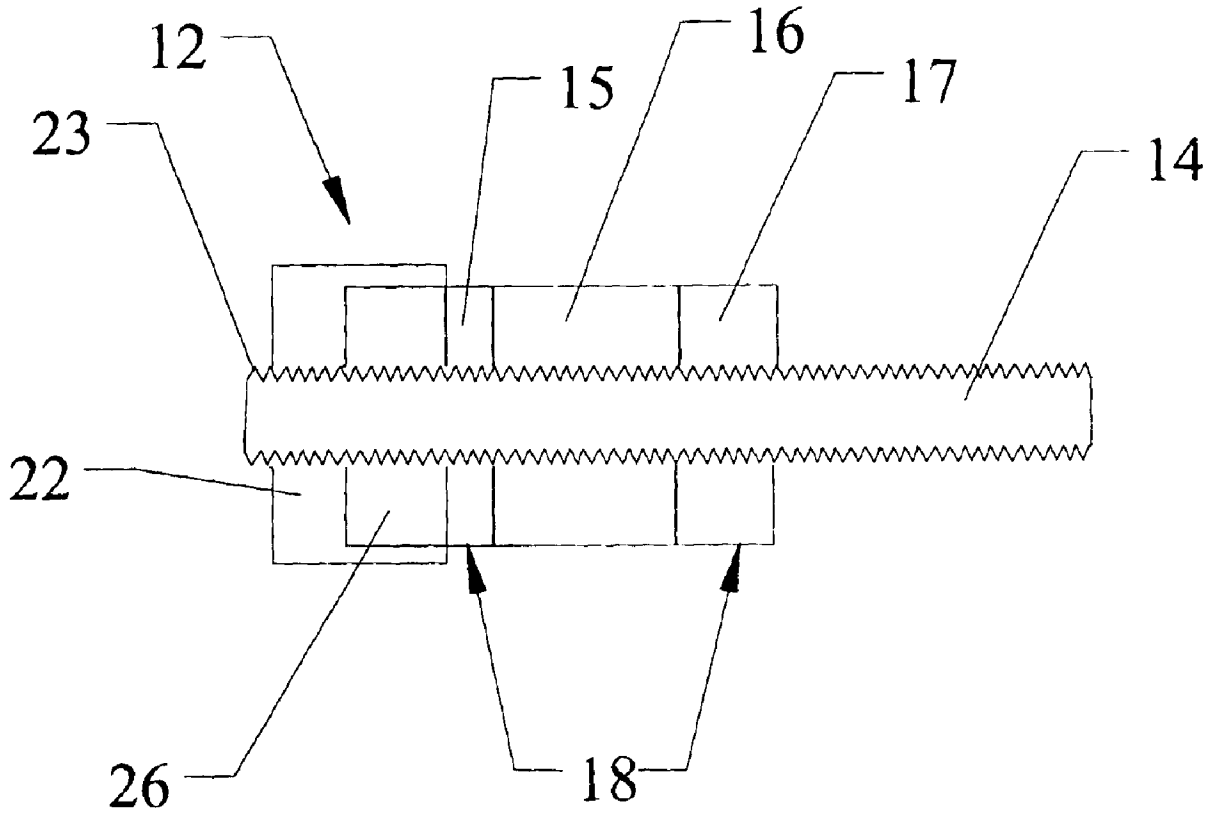
FIG. 1 is a cut away side view of one embodiment of the abrading tool of the present invention.

Referring first to FIG. 1, one embodiment of the abrading tool 10 of the present invention is shown. In its most basic form, the abrading tool 10 includes a threaded drive rod 14, a means 12 for retaining an abrasive material (not shown) about the threaded drive rod 14, an expandable support 16 disposed about the threaded drive rod 14 and dimensioned to brace the abrasive material, and a means 18 for expanding the expandable support 16.

The threaded rod 14 is preferably manufactured of metal and has a fine pitch thread to allow fine adjustment of the diameter of the expandable support 16. In the embodiment of FIG. 1, the threaded rod 14 has threads along its entire length and, therefore, is adapted to be secured into a female threaded coupling (not shown) that attaches to a source of rotation. However, in other embodiments, the threaded rod 14 is only threaded at the end in which the means 12 for retaining an abrasive material and the expandable support 16 are disposed. In some of these embodiments, the other end of the rod is a drive end dimensioned to allow the rod to be gripped by a drill chuck, quick change system, or other art recognized means of securing a rotating tool to a source of rotation. In others, the non-threaded end of the threaded rod 14 is dimensioned to form a part of a calibration system (not shown), which allows a user to accurately set the diameter of the expandable support 16 such that the abrasive material will conform to an opening to be abraded.

The expandable support 16 and means 18 for expanding the expandable support 16 sit about the threaded rod 14 between the means 12 for retaining the abrasive material and the drive end of the threaded rod 14. The expandable support 16 shown in FIG. 1 is manufactured of a compressible elastic material, such as natural or synthetic rubber, and is formed in the shape of a cylinder of suitable dimension to support the abrasive material as the tool is thrust into a workpiece. When compressed, the expandable support 16 of FIG. 1 bulges, causing its diameter to increase. Consequently, the diameter formed by the abrasive material supported thereby is likewise increased. In operation, one need only increase the diameter of the expandable support 16 to a diameter larger than that of the hole to be abraded to cause the abrasive material to abrade the inside of the hole.

Figure 7:
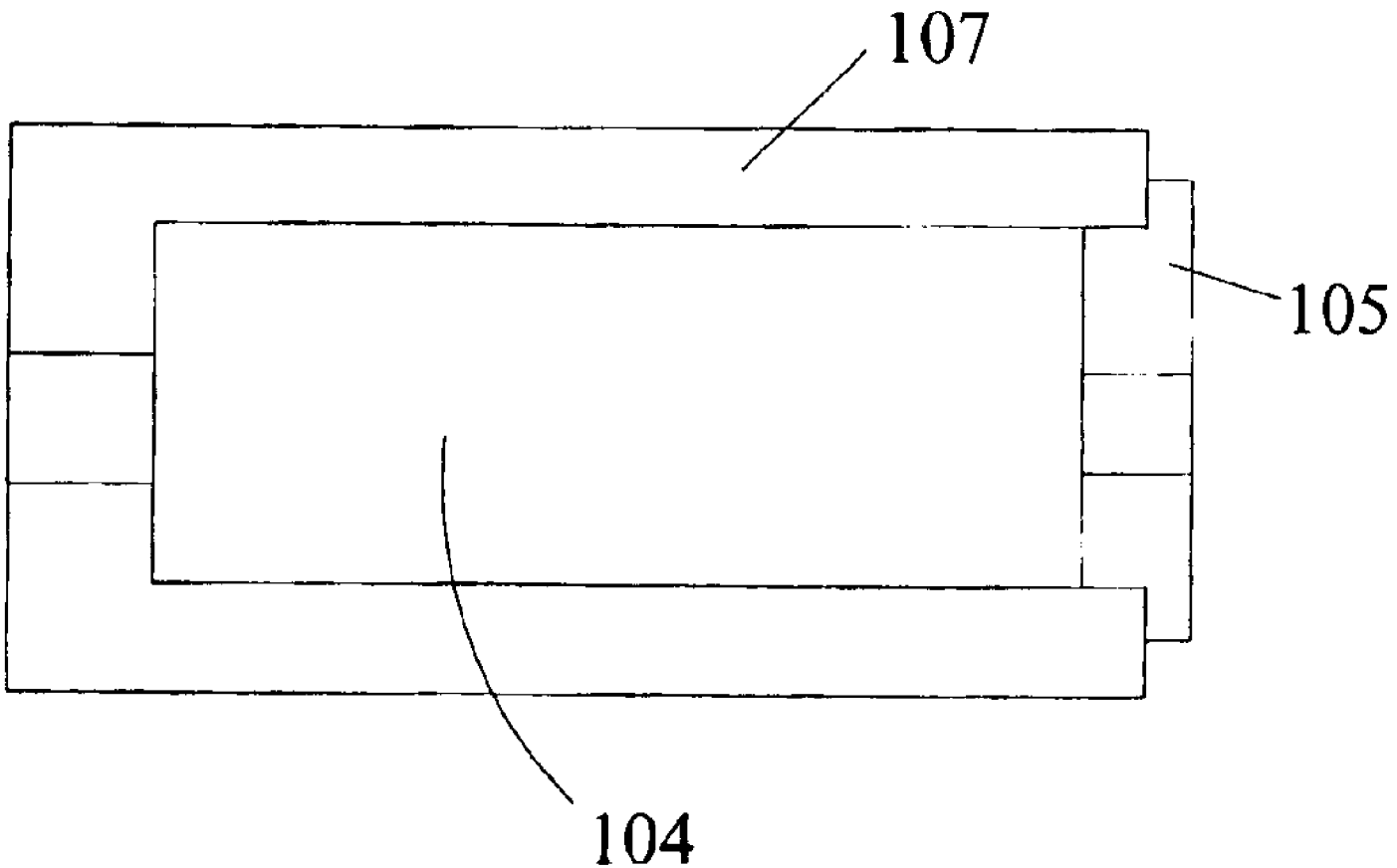
FIG. 7 is a cut away side view of an alternative embodiment of the expandable support.

When abrading holes greater than one and one half inches, the partially hollow expander 107 shown in FIG. 7 is the preferred drum-type expandable support. This expander 107 is preferably constructed of a more rigid rubber material, such as 65-durometer rubber, than the smaller drum-type expandable support in order to reduce vibration and or chatter caused by excessive deformation of the material. The higher rigidity of this material necessitates the inclusion of the hollow portion 104 to allow the support to expand. This expandable support also includes a drum cap 105, which fits within the hollow portion 104 to seal the interior of the expander 107.

Figure 8:
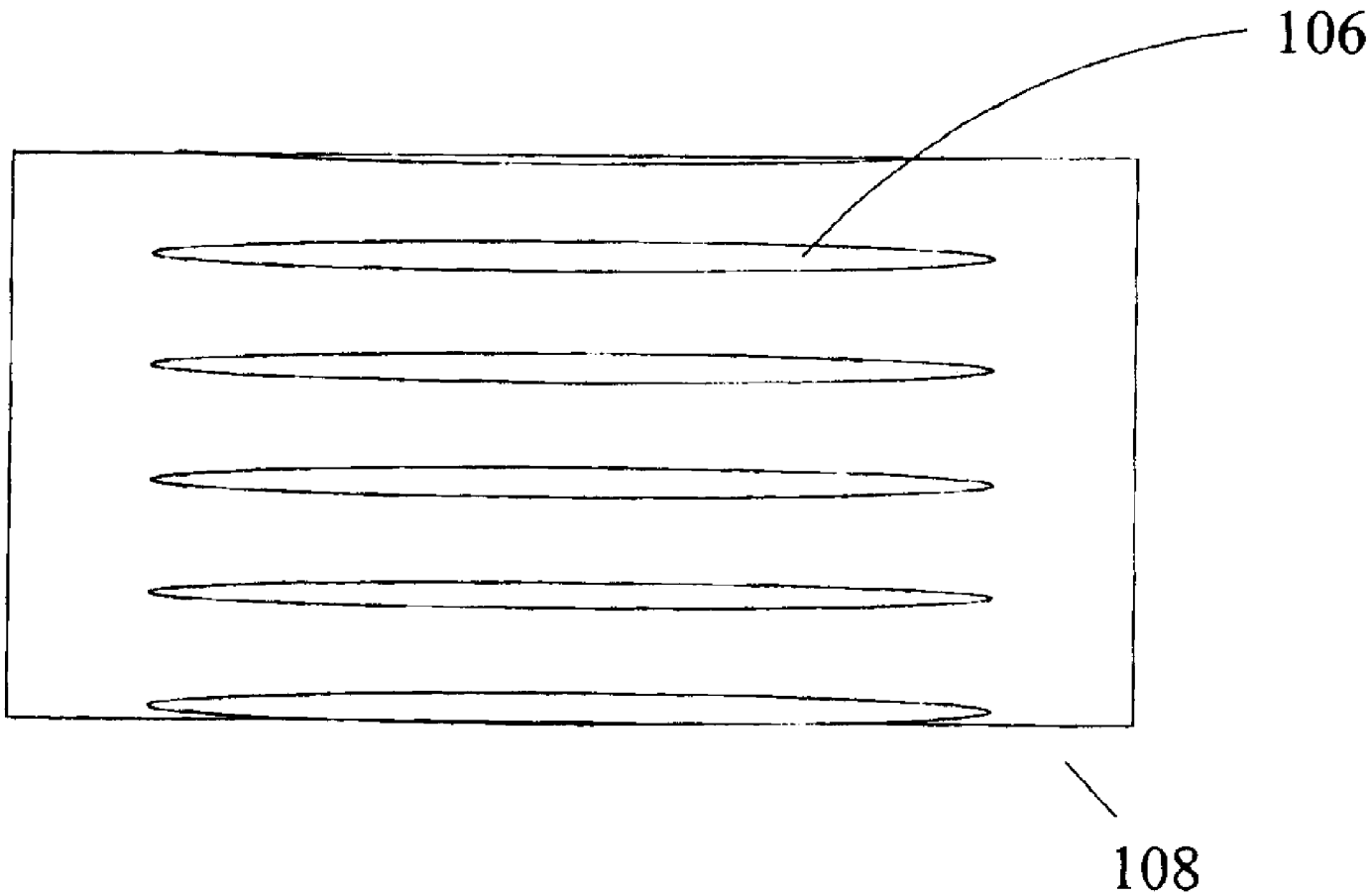
FIG. 8 is a side view of another alternative embodiment of the expandable support.
Figure 9:
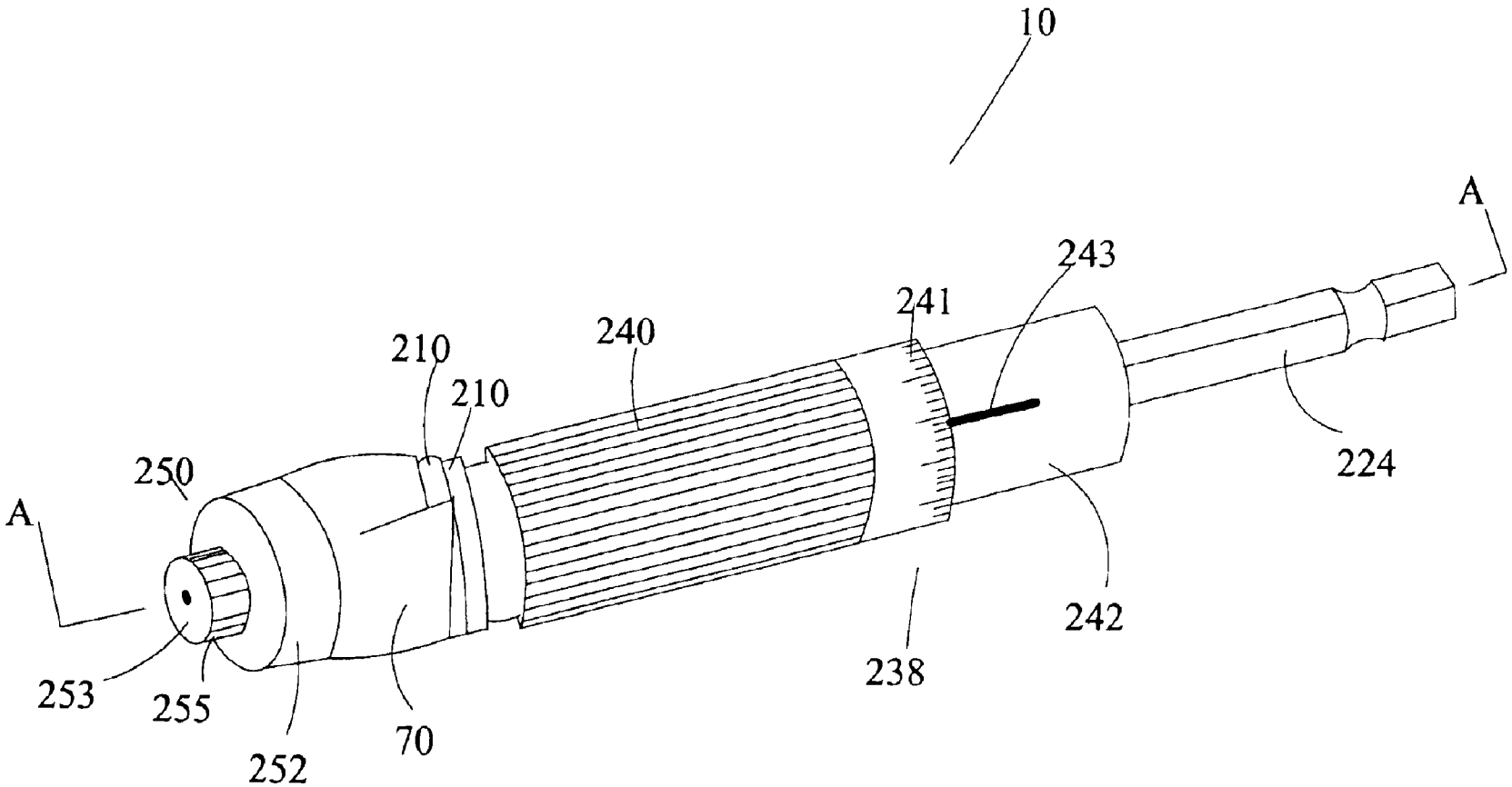
FIG. 9 is an isometric view of the of the preferred abrading tool of the present invention for abrading holes and bores
Figure 10:
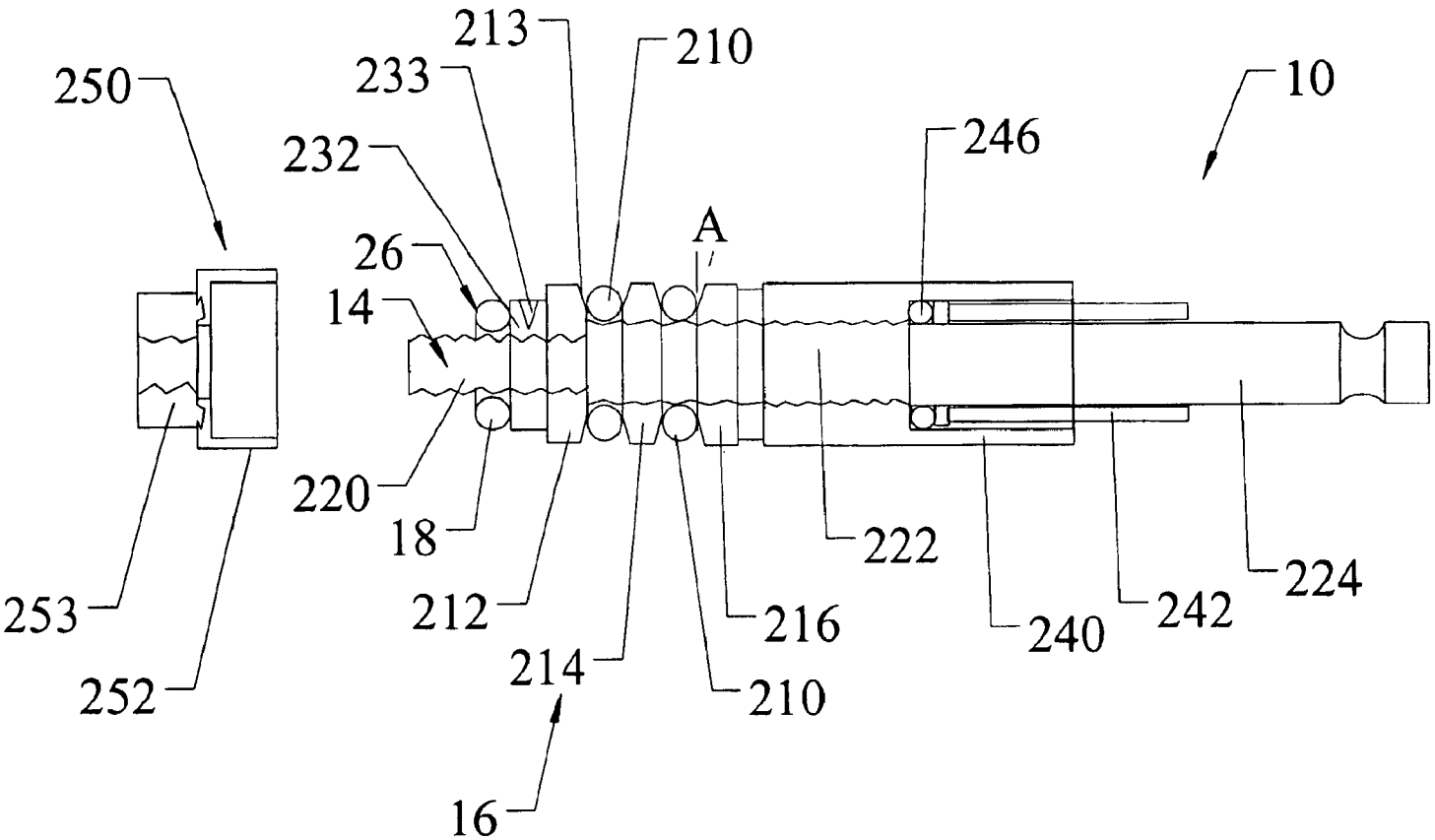
FIG. 10 is a cut away side view of the preferred abrading tool FIG. 9.
Figure 11:
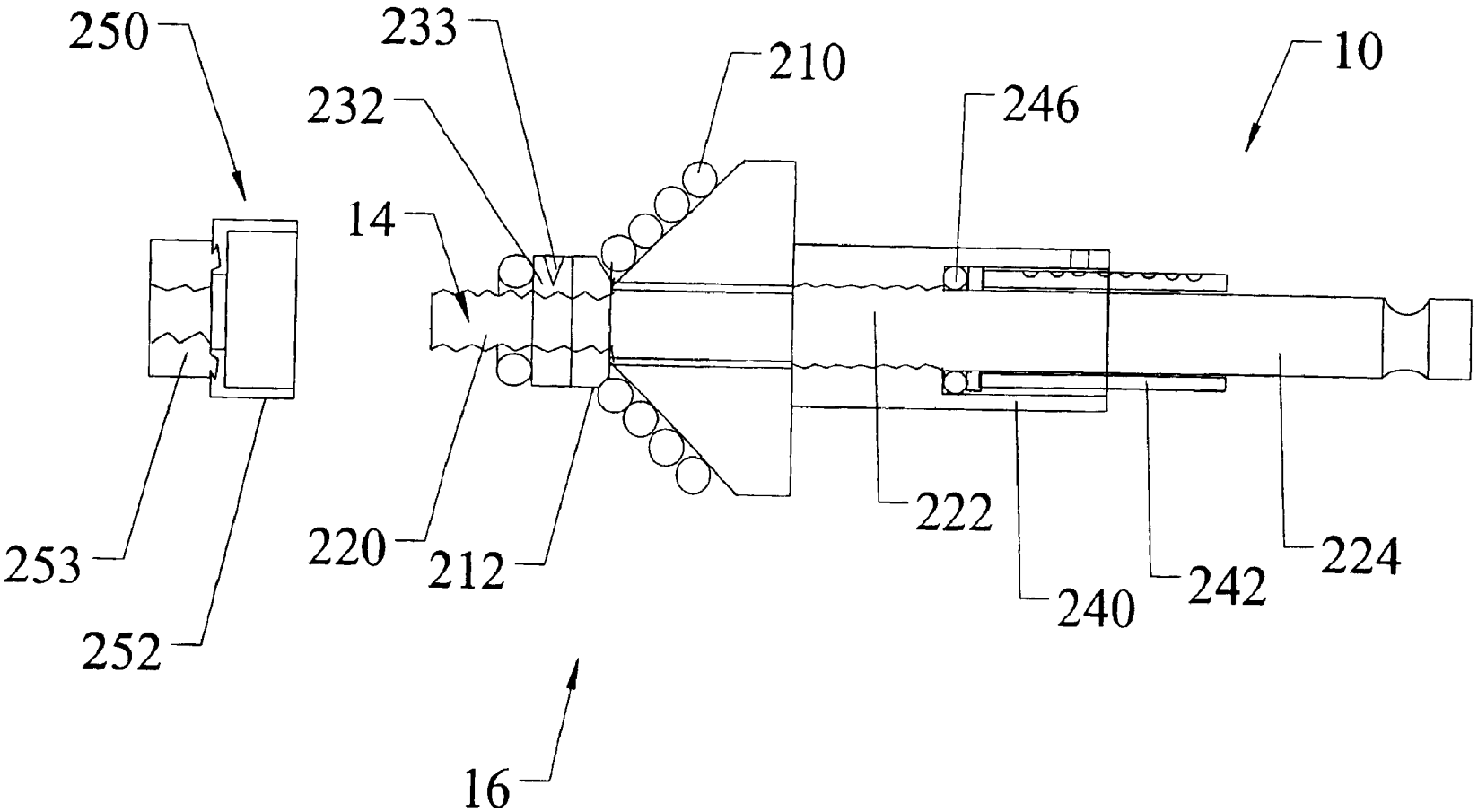
FIG. 11 is a cut away side view of the preferred abrading tool of the present invention for abrading chamfers.

As shown in FIG. 8, the expandable support may likewise take the form of an expanding drum 108 with axial slits 106, which allows for a large contact surface with the abrasive star. Due to its elasticity and lack of brittleness, nylon is the preferred material from which to construct the expanding drum, although those of skill in the art would recognize that other materials may be readily substituted to achieve similar results. However, as shown in FIGS. 9–11, the preferred expandable support is a plurality of compressible O-rings 210, manufactured of buna-N, neoprene, viton or the like, which are disposed between a plurality of spacers 162.

Referring again to FIG. 1, the preferred means 18 for expanding a drum-type expandable support 16 includes an inner spacer 15 and outer spacer 17 disposed on opposite sides of the expandable support 16. The spacers 15, 17 are each dimensioned to allow an axial force upon one of the spacers 15, 17 to compress the expandable support 16 against the other of the spacers 15, 17 such that the diameter of the support 16 is enlarged, and such that a removal of this axial force causes the diameter of the support 16 to be reduced. In some embodiments, the spacers 15, 17 are simple washers that are constructed of plastic and the means 18 for expanding the support also includes an adjusting knob (shown in FIG. 2) that drives the outer spacer 17 toward the inner spacer 15, which is held in a stationary position by the means 12 for retaining the abrasive material. In other embodiments, one or both of the spacers 15, 17 are threaded and may be actuated to provide the necessary compressive force. Aside from accepting force from the expandable support 16, threading the inner spacer 15 allows a machinist to remove the means for retaining an abrasive material 12 without affecting the diameter of the expandable support 16.

The means 12 for retaining the abrasive material is disposed proximate to the expandable support 16 and is sized to hold a portion of the abrasive material in position, while allowing the remainder of the material to conform to the expandable support 16. In the embodiment of FIG. 1, the means 12 for retaining an abrasive material includes a lock cap 22 and a compressible locking member 26 that act to retain the abrasive material in position. The lock cap 22 has an opening 23 disposed about the threaded drive rod 14 and an inside surface 24 dimensioned to mate with the outside surface of an abrasive material. The lock cap 22 is preferably constructed of plastic and is a substantially hollow cylinder with one open face, allowing access to the inside surface 24, and one closed face forming the end of the tool 10. The lock cap 22 must remain stationary during operation of the tool and, therefore, the opening 23 therethrough is preferably threaded. However, in some embodiments the opening 23 is unthreaded and the lock cap 22 is retained by clips, pins, or other art recognized means for securing a cap to a rod.

The compressible locking member 26 is disposed about the threaded rod 14 proximate to the inside surface of the abrasive material and is preferably dimensioned to create an interference fit with the inside surface 24 of the locking cap 22. Because of this interference fit, positioning the abrasive material between the locking member 26 and the inside surface 24 of the locking cap 22 causes the compressible locking member 26 to exert a static frictional force to hold the hub of an abrasive flush against the lock cap 22. However, it is recognized that the compressible locking member 26 may take various forms. For example, some embodiments, such as the embodiments of FIGS. 4, 9 & 10, utilize an elastic ring 17, such as an O-ring 18, to affect this compressive force. In others, the compressible locking member 26 is made up of a plurality of compressible protrusions 20 extending from the inner spacer 15, or any directly adjacent structure.

Figure 2:
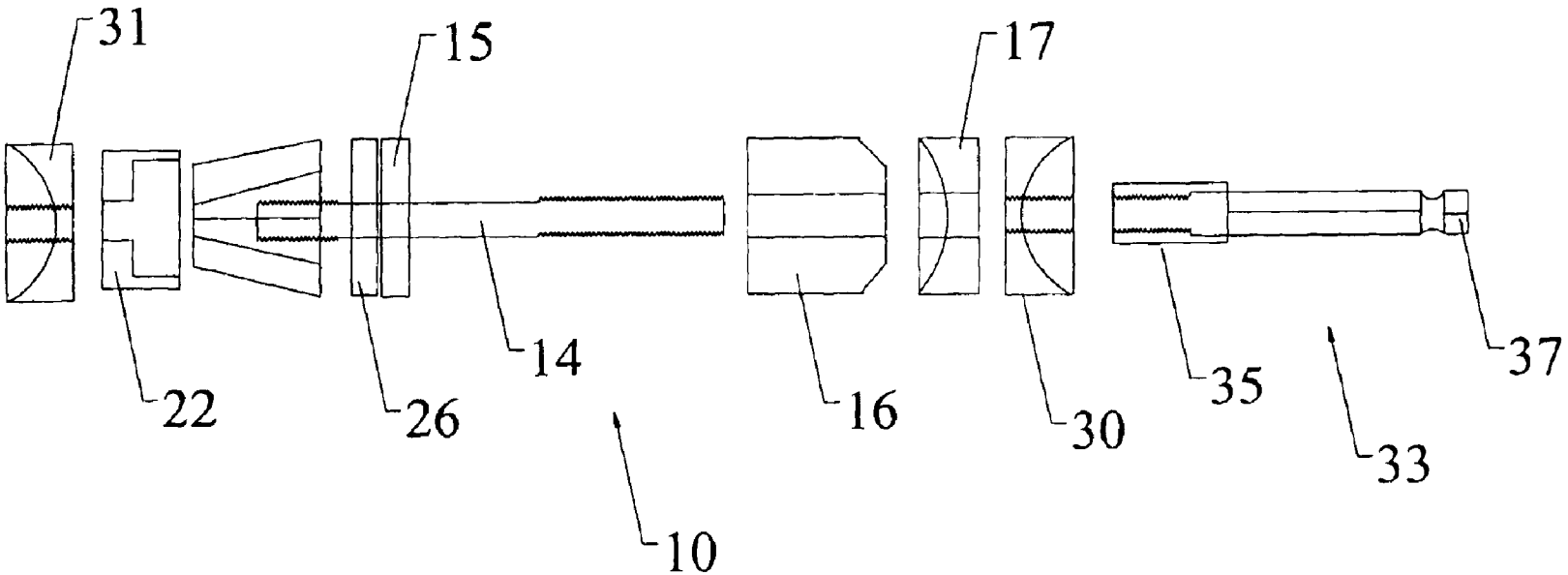
FIG. 2 is a cut away side view of the one embodiment of the abrading kit of the present invention.

Now referring to FIG. 2, the preferred embodiment of the abrading kit 50 is shown. The abrading kit 50 includes an abrading tool 10, such as the tool 10 described with reference to FIGS. 1, 9 or 10, and an abrasive star 70 attached to the abrading tool.

In the embodiment of FIG. 2, the abrading tool 10 includes a means 18 for expanding the expandable support 16 that also includes an adjusting knob 30, which acts to drive the outer spacer 17 toward the inner spacer 15. The adjusting knob 30 is threaded and is preferably fabricated of plastic due to its low cost, although it is recognized an adjusting knob 30 manufactured of metal would offer advantages in many applications. In the preferred embodiment, the adjusting knob 30 contains gripping details, such as sloping walls, bumps, serrations, or the like, to allow a user to grip and radially turn the adjusting knob 30 by hand without the use of a separate tool. This radial turning motion translates into axial movement along the threaded drive rod 14, causing the knob 30 to engage the outer spacer 17, which is unthreaded in this embodiment, and moves the outer spacer 17 toward the expandable support 16.

In the embodiment of FIG. 2, the inner spacer 15 is made of plastic and takes the shape of a squat cylinder. Unlike the preferred outer spacer 17 described above, the preferred inner spacer 15 is threaded. The threading anchors the inner spacer 15 to the threaded drive rod 14, creating a stationary piece against which the expandable support 16 may bear. The expandable support 16 of this embodiment is similar in all respects to the support 16 described with reference to FIG. 1 except that it slopes at an angle towards the outer spacer 17 in order to aid in the compression thereof. However, it is recognized that other embodiments of the expandable support 16 do not include such an angle.

The preferred means 12 for retaining the abrasive star 70 includes a locking cap 22, which engages the abrading portion of the abrasive and receives the static frictional force of the compressible locking member 26, as described with reference to FIG. 1 above. However, the preferred lock cap 22 is not threaded and uses a lock knob 31 to provide the necessary compressive force to lock the abrasive star 70 in place between the lock cap 22 and locking member 26. The lock knob 31 is typically threaded, fabricated of plastic and contains sloping walls that allow the thumb and forefinger to rotate it. However, other embodiments may utilize a lock knob 31 that is dimensioned as a simple nut, having a polygonal outer surface adapted for gripping by a wrench or other tool commonly utilized for tightening a nut to a bolt. In others, the lock knob 31 is a quick connect/disconnect type knob, allowing it to be attached and removed by a simple downward push and quarter turn motion.

The abrading tool 10 may also include a drive member 33 attached to, of formed integral to, the drive end of the threaded rod 14. The drive adapter 33 includes a threaded end 35, that is dimensioned to accept the threaded rod, and a drive end 37 that is dimensioned to allow the adapter 33 to be gripped by a drill chuck, quick change system, or other art recognized means of securing a rotating tool to a source of rotation.

As shown in FIG. 2, the abrasive star 70 of the preferred kit is die cut and folded upward and over the expandable support to form the shape of a cylinder having an open end and a closed end. However, it is recognized that as the expandable support 16 expands, this cylindrical shape to the outer surface will become a substantially conical shape, with the ends of the abrasive star 70 only conforming to the support 16 when opposed by the inside surface of a bore.

Figure 3:
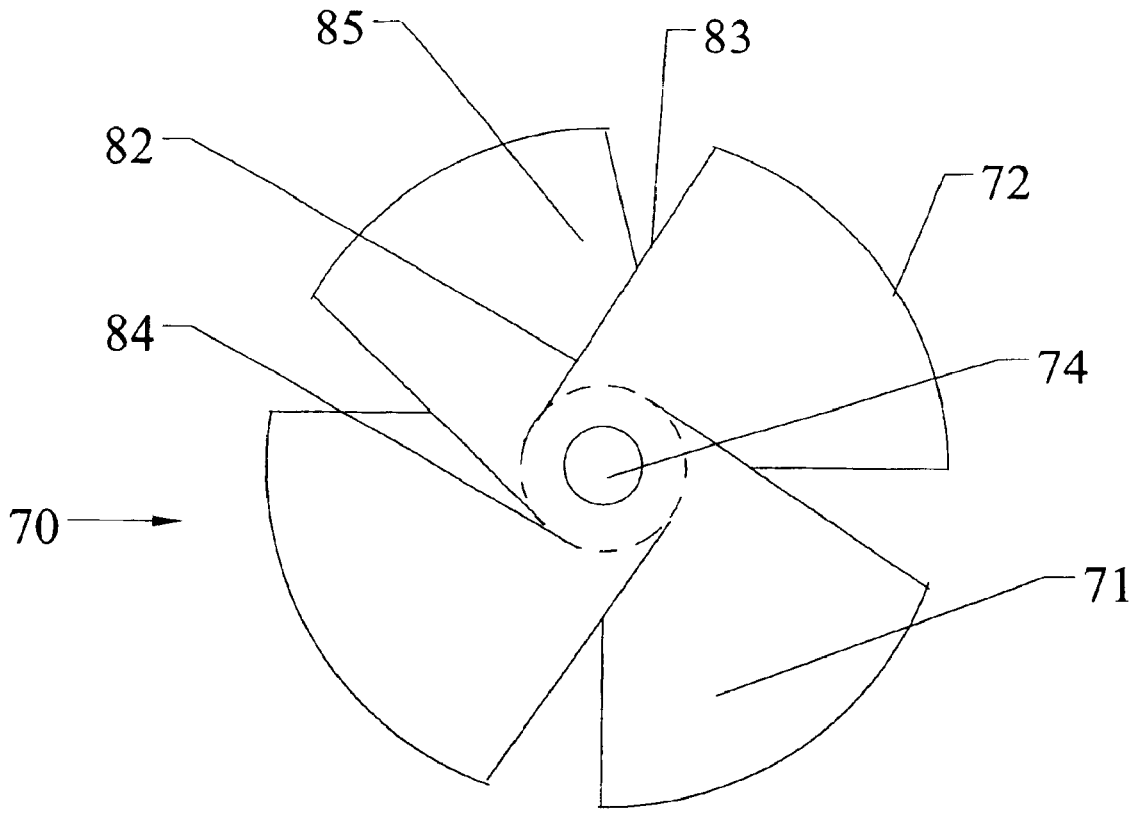
FIG. 3 is a top view of the one embodiment of the abrasive star of the present invention.
Figure 4:
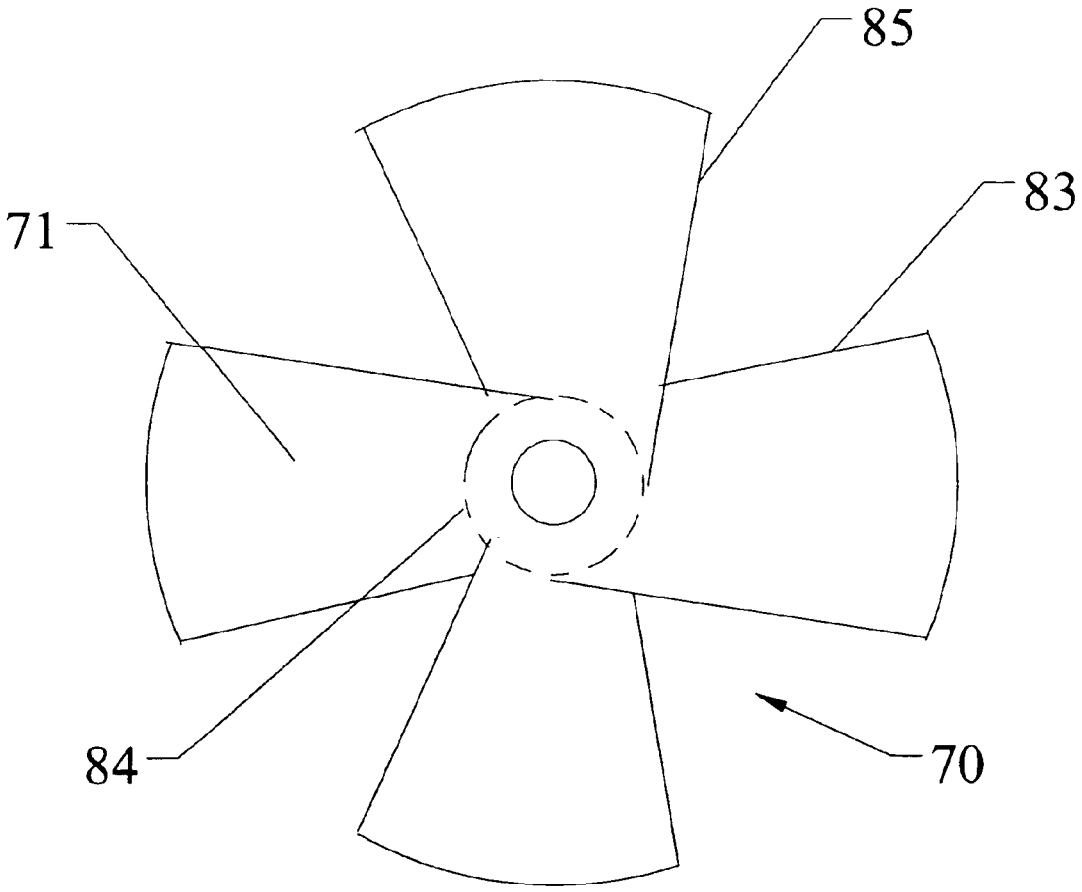
FIG. 4 is a top view of the one embodiment of the abrasive star of the present invention.

As shown in FIGS. 3 and 4, two embodiments of the abrasive star 70 of the present invention are shown. The star 70 includes a central hub 84 having an opening 74 dimensioned to accept the drive rod, and a plurality of flaps 71 that extend from the central hub 84. The flaps 71 are defined by a plurality of gaps 76, and each flap 71 includes a left side 83, a right side 85 and an end 72. A slit 82 is disposed through one side of each flap 71 proximate to the central hub 84 and extends substantially tangentially to the hub 84 toward the opposite side of each flap 71. The gaps 76 and slits 82 are dimensioned to allow the flaps 71 to be folded upward such that right side 85 of each flap 71 overlaps the left side 85 of each adjacent flap 71. As described above with reference to FIG. 2, this forms a continuous substantially cylindrical outer surface, or a substantially conical outer surface, when the star 71 is attached to the abrasive tool.

As shown in FIG. 3, the slits 82 are merely extensions of the left side 83 of each flap and extend substantially into the right side 85 of each adjacent flap. However, as shown in FIG. 4, the slits 82 may be disposed on the left side 83 to achieve similar results. It is preferred that the gaps 76 between flaps 71 be substantially triangularly shaped and extend from the end 72 of adjoining flaps 71 toward the central hub 84. As is evident by a comparison of FIGS. 3 and 4, the extension of each gap 76 toward the hub 84 will vary depending upon the size and disposition of each slit 82. Accordingly, the gaps 76 and slits 82 work in combination to produce the desired continuous surface.

Regardless of the form taken by the abrasive star 70, it is preferably that it be manufactured from a substantially flexible material having a plurality of abrasive particles disposed upon one surface thereof. Generally any type of sandpaper fashioned to fit about the expandable support is suitable. A "J" weight flex-back sandpaper is preferred in smaller diameter applications because it conforms to a rubber expandable support as the tool turns. Supports having expanded diameters in excess of one and one half inches are preferably manufactured of heavier "X" weight sandpaper. However, it is recognized that other types of abrasives having flexible backing, such as common cloth or rubber-backed abrasives, could be substituted to achieve similar results.

Figure 5:
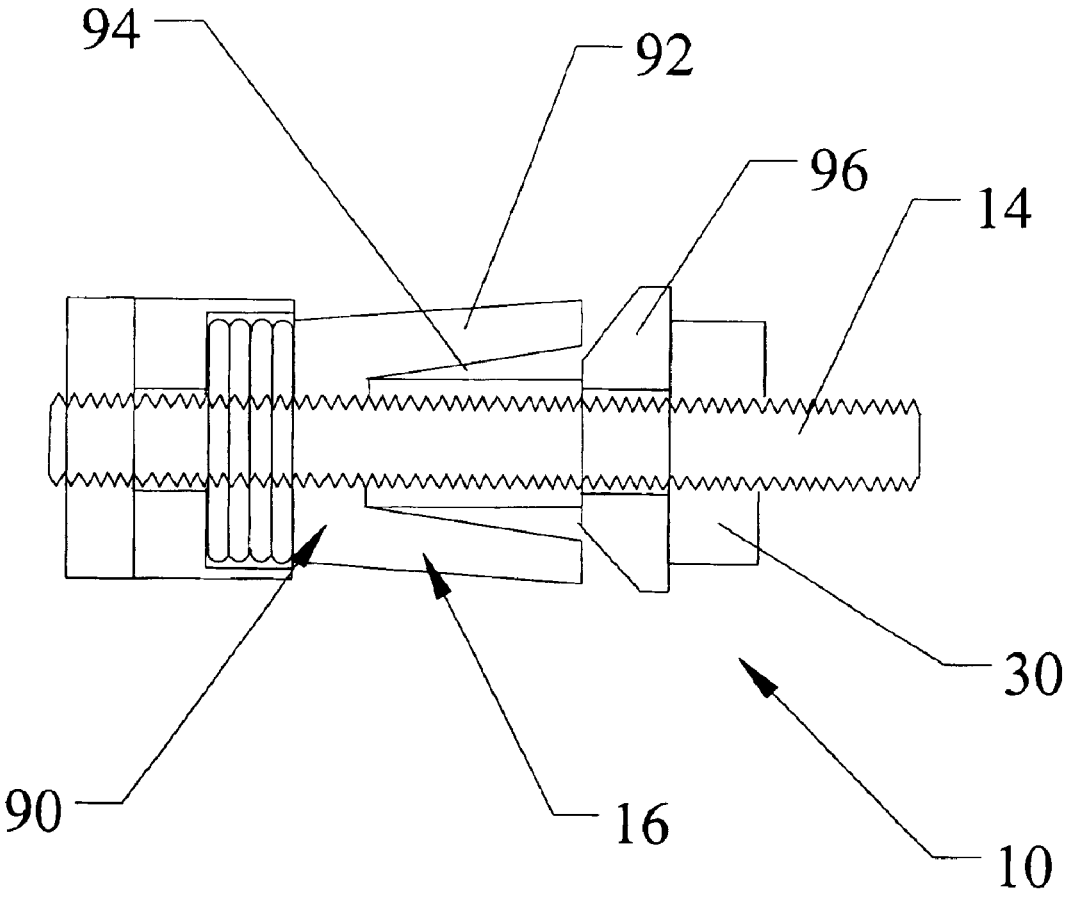
FIG. 5 is a cut away side view of an alternative embodiment of the abrading kit of the present invention adapted to abrade a chamfer.

FIG. 5 shows another embodiment of the abrading tool 10 that is adapted for abrading a chamfer on an opening. This embodiment of the tool is substantially the same as those described with reference to FIGS. 1 and 2 except for the use of a different expandable support 16 and different means 18 for expanding the expandable support 16.

In the embodiment of FIG. 5, the expandable support 16 is a substantially resilient cylinder 90 having an open end, a closed end and a side wall 92 having a plurality of axial cuts 94 disposed therethrough, which allow the side wall 92 may be forced outward to form a substantially conical surface. The preferred resilient cylinder 22 is manufactured of a nylon, which is threaded to receive the drive rod 14. However, other embodiments may include a separate threaded member mounted opposite the closed end for holding the cylinder in place. In the embodiment of FIG. 5, the means 18 for expanding the expandable support 16 is a plunger 96 having a substantially conical shape that allows it to gradually force the side wall 92 of the cylinder 90 outward as it is moved toward the cylinder. It is preferred that the plunger 96 be unthreaded and fabricated of plastic, as the lack of threading allows it to remain substantial radial stability during axial movement to provide a smoother mating between it and the adjacent resilient cylinder 90. In this preferred embodiment, the plunger 96 is moved axially by an adjusting knob 30, such as those described with reference to FIG. 2. However, in other embodiments, the plunger 96 is threaded and is provided with details to allow it to be rotated on the threaded rod 14 and the adjusting knob 30 is eliminated. Likewise, in some embodiments, the plunger 96 includes a plurality of notches (not shown) therein that are dimensioned to mate with the side wall 92 of the cylinder 90 and act to prevent the side wall 92 from catching against the material to be abraded. In still other such embodiments, an elastic band (not shown) such as those used to disable the claws of live lobsters is wrapped around the cylinder 90 and acts both as a spring, depressing the cylinder 90 against the plunger 96, and as a frictional member that provides a better grip on the abrasive star than the preferred nylon cylinder 90.

Figure 6:
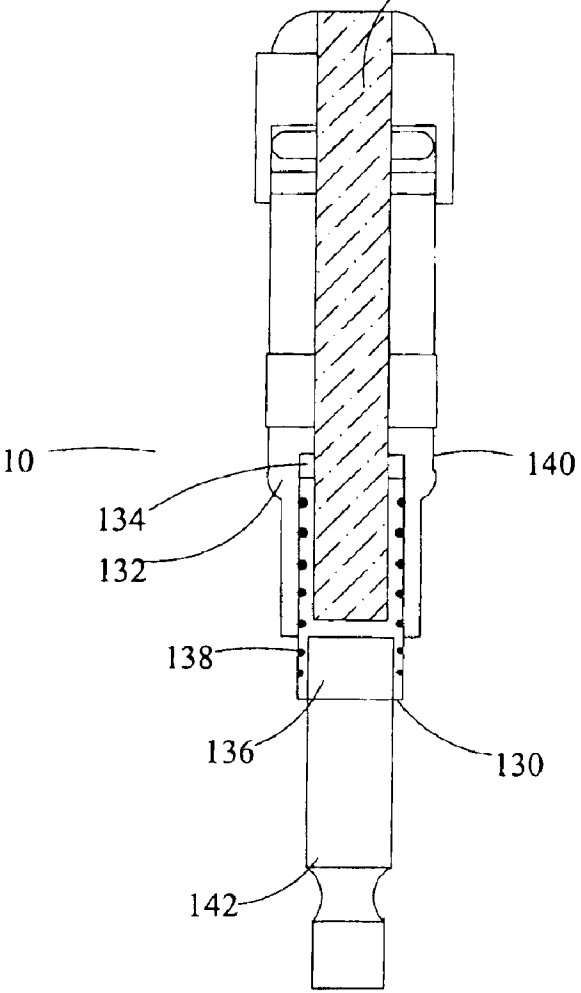
FIG. 6 is a side view of an alternative embodiment of the abrading kit of the present invention showing the preferred means for setting the diameter of the expandable support to a desired diameter.

Referring now to FIG. 6, another embodiment of the abrading tool 10 is shown. In this embodiment, a means for setting the diameter of the expandable support 16 to a desired diameter is provided. As shown in FIG. 6, this means includes a sleeve 130 that fits within a bore 134 in the adjusting knob 132 and includes a plurality of marks 138 disposed incrementally along its outer surface 136 in positions corresponding to a plurality of diameters of said expandable support. The location of each mark 138 is easily determined empirically. In operation, the user will tighten or loosen the adjusting knob 132 until the end 140 of the adjusting knob 132 is aligned with a mark 138 corresponding to the desired diameter. However, it is understood that those of ordinary skill in the art would readily recognize other means for setting the diameter of the expandable support. Further, it is understood that the marks 138 may be disposed to set the angle of chamfer in relation to a side of a hole in substantially the same manner.

In addition to serving as part of the means for setting the diameter of the support, the sleeve 130 of FIG. 6 also serves as part of a quick disconnect system. Here, the sleeve 130 threads to the threaded rod 14 at one end and includes an bore 136 dimensioned to accept a drill driver 142 or other art recognized connector to allow the tool to be readily connected and disconnected from its source of rotation.

Referring now to FIGS. 9 and 10, the preferred embodiment of the abrading tool 10 for use in abrading cylindrical holes or bores is shown. The preferred abrading tool 10 performs the same function as the other disclosed embodiments and includes the same functional elements of these embodiments. However, the embodiment of FIGS. 9 and 10 has several differences that make it advantageous over the embodiments discussed above.

First, the preferred expandable support 16 is not an elastic drum, but rather a stacked arrangement of compressible O-rings 210, manufactured of buna-N, neoprene, viton, or the like, and non-compressible spacers 212, 214, 216. The use of O-rings 210 and spacers 212, 214, 216 as the expandable support 16 is advantageous due to their relatively low cost and ready availability when compared to elastic drums.

As shown in detail in FIG. 10, the spacers 212, 214, 216 each have angled edges 213 disposed adjacent to the O-rings 210. The preferred spacers 212, 214, 216 are delrin spacers with edges 213 disposed at an angle A between ten degrees (10°) and forty-five degrees (45°), with the preferred angle A being a twenty degree (20°) angle, against the side of the O-rings 210. These angled edges 213 provides the adjacent portion of the O-ring 210 with a surface along which it may slide when the O-rings 210 are compressed, allowing for easier compression thereof. Further, when the O-rings 210 are at maximum adjustment, the spacing between the spacers 212, 214, 216 will allow the O-rings 210 bottom out at the dimension needed for maximum hole size. For example, a twenty degree (20°) angle would produce a relatively small gap between adjacent spacers and a relatively large displacement of the O-rings 210. Conversely, a forty-five degree (45°) angle will produce a relatively large gap and a correspondingly small displacement. Despite the fact that the preferred spacers 212, 214, 216 have angled edges, it is recognized that spacers 212, 214, 216 having no such angled edges 213 may be substituted to achieve similar results.

Second, the preferred tool 10 differs from those of other embodiments in that it utilizes a threaded rod 14 that includes threaded portions 220, 222 of different diameters, and a drive portion 224 that is formed integral to the drive end of the threaded rod 14. By using threaded portions 220, 222 of different diameters, compressible locking member 26, here an O-ring 18, of a smaller diameter than those of the expandable support 16 may be used. In addition, the locking nut 232, adjacent to the compressible locking member 26, maybe set at a fixed distance from the end of the rod 14. However, in the preferred embodiment, the locking nut 232 includes a hollowed portion 233 that allows the nut 232 to be staked into position after assembly such that it may not be moved backward or forward along the threaded rod 14, effectively serving the same purpose.

In the preferred embodiment, the front threaded portion 220 has a fine 10–32 thread, which is mote resistant to vibration than courser threads. However, it is recognized that course threads could be used in applications in which vibration is not a significant factor.

The preferred compressible locking member 26 is an O-ring made of sixty-five durometer material, which prevents the member 26 from being destroyed or distorted in the event that the cap 236 loosens sufficiently to allow the abrasive to spin. Further, it is preferred that the O-rings 210 making up the expanding member 16 likewise be manufactured of a sixty five durometer material in order to prevent softening at temperature. However, it is recognized that O-rings manufactured of forty to seventy durometer material may be substituted to achieve similar, though less than ideal, results.

The use of a threaded drive rod 14 having a drive portion 224 that is formed integral to the drive end of the threaded rod 14 has a number of advantages. First, the original embodiments utilized a three inch long 10–24 stainless threaded rod, which was threaded ¼" into a 1¼" long by ¼" stainless hex drive, resulting in a tool having a total length of four inches long. However, when locked together, runout became a problem. Further, the 10–24 threaded rod was found to be easy to bend if the tool went over recommended RPM, which is from 400 RPM to 2,000 RPM. By changing got a unitary rod 14, speeds of 23,000 RPM have been achieved without bending and with minimal runout.

The third major difference is the addition of a micrometer type assembly 238 for setting the diameter of the expandable support 16 to a desired diameter. In this preferred embodiment, the second threaded portion 222 has a ¼–28 thread, which allows for thirty adjustment marks 241 for 0.001 thousands per mark, or 1/32 per revolution on the adjustment knob 240. These marks are then aligned with a fixed mark 243 on the sleeve 242 that mates with the unthreaded portion of the inner bore of the knob 240. This means that the diameter to be abraded may be controlled to extremely fine tolerances. Further, in this embodiment, an O-ring 246 has also been added inside the adjustment knob 240 to keep pressure inside the knob so that a heavy cut during the operation of the tool 10 will not cause the adjustment knob 240 to rotate or push back.

Finally, the preferred tool 10 utilizes a cap assembly 250, which combines an unthreaded lock cap 252 with a threaded lock knob 253. The lock knob 253 of the preferred cap assembly 250 is interlocked with the lock cap 252 using a taper lock system, which allows the lock knob 253 to be rotated, but keeps both pieces together to avoid loss of the lock knob 253. The preferred lock knob 253 has gripping ridges 255 that allow the knob 253 to be easily rotated by hand.

Referring now to FIG. 11, the preferred embodiment of the tool 10 for use in creating and/or polishing chamfers is shown. This embodiment of the tool 10 is similar in all respects to the embodiment of FIG. 10 except that the expandable support 16 utilizes three O-rings 270, 272, 274, each having different diameters, and a tapered spacer 276, upon which the second and third O-rings 272, 274 sit. In operation the tapered spacer will be incrementally moved forward to compress and enlarge the diameter of the O-rings 270, 272, 274, creating a greater chamfer angle, backward to decompress the O-rings 270, 272, 274 and create a lesser chamfer angle. The control of this chamfer angle is done in a manner similar to that of the control of diameter in the embodiment of FIG. 10, with the marks 241 on the adjustment knob 240 corresponding to angular displacement such that aligned of one of the marks 241 with a fixed mark 243 on the sleeve 242 that mates with the unthreaded portion of the inner bore of the knob 240 will result in a chamfer of a known angle.

Although the present invention has been described in considerable detail with references to certain preferred versions thereof, other versions would be readily apparent those of ordinary skill in the art. Therefore, the spirit and scope of the appended claims should not be limited to the description of the preferred versions contains herein.

What is claimed is:

1. An abrading tool comprising:

a threaded drive rod;

a means for retaining an abrasive material about said threaded drive rod;

an expandable support disposed about said threaded drive rod and proximate to the abrasive material, said support being dimensioned to brace said abrasive material, wherein said expandable support comprises at least one compressible O-ring;

a means for expanding said expandable support, said means being disposed about said threaded drive rod, wherein said means for expanding said expandable support comprises at least two substantially rigid spacers, and wherein said spacers and said at least one O-ring are disposed about said threaded rod such that each of said at least one O-ring is disposed between two spacers; and means for setting a diameter formed by said expandable support, said means comprising:

an adjusting knob comprising an inner bore and an outer surface, wherein said inner bore is threaded to mate with said drive rod and thread onto said drive rod in communication with said means for expanding said expandable support such that radial rotation of said adjusting knob in a first direction causes said expandable support to expand and such that radial rotation of said adjusting knob in a second direction causes said expandable support to contract, and wherein said outer surface comprising a plurality of marks disposed incrementally along said outer surface in positions corresponding to a plurality of diameters of said expandable support, and a sleeve substantially fixedly attached to said threaded drive rod, said sleeve comprising an outer surface dimensioned to fit within said inner bore of said adjusting knob and at least one mark disposed upon said outer surface of said sleeve.

2. The abrading tool of claim 1 wherein said means for retaining an abrasive material comprises:

a lock cap, having an opening disposed about said threaded rod, said lock cap having an inside surface dimensioned to mate with and proximate to an outside surface of said abrasive material; and a compressible locking member disposed about said threaded rod, proximate to an inside surface of said abrasive material.

3. The abrading tool of claim 2 further comprising a lock knob having a threaded opening to mate with the threaded rod and an engagement surface dimensioned to engage a mating surface of said lock cap.

4. The abrading tool of claim 1 wherein each of said at least two spacers comprises at least one angled edge.

5. The abrading tool of claim 1 wherein said threaded drive rod comprises a first threaded portion having a first diameter, a second threaded portion having a second diameter and a drive portion.

6. The abrading tool of claim 5 wherein said threaded drive rod is a unitary rod and wherein said drive portion is dimensioned and shaped to mate with a quick connect fitting.

* * * * *